United States Patent [19]

Larsson

[11] Patent Number: 4,635,730

[45] Date of Patent: Jan. 13, 1987

[54] GRADER ATTACHMENT FOR A LOADER

[75] Inventor: Gunnar Larsson, Skövde, Sweden

[73] Assignee: AB Vretens Mekaniska Verkstad, Skövde, Sweden

[21] Appl. No.: 734,584

[22] Filed: May 15, 1985

[30] Foreign Application Priority Data

May 18, 1984 [SE] Sweden ..... 8402673

[51] Int. Cl.[4] ..... E02F 3/76

[52] U.S. Cl. ..... 172/788; 37/117.5; 172/247; 172/253

[58] Field of Search ..... 172/247, 253, 292, 272, 172/273, 274, 781, 788, 791, 780, 784; 37/117.5

[56] References Cited

U.S. PATENT DOCUMENTS

| | | | |
|---|---|---|---|
| 2,629,946 | 3/1953 | Ewers et al. | 172/788 X |
| 2,698,491 | 1/1955 | Felt . | |
| 3,027,662 | 4/1962 | Cunningham . | |
| 3,478,833 | 11/1969 | Breon et al. | 172/781 UX |
| 3,822,756 | 7/1974 | Martin | 172/247 X |
| 3,881,563 | 5/1975 | Hammersmith | 172/781 X |
| 3,889,976 | 6/1975 | Jesswein | 172/781 X |
| 3,976,146 | 8/1976 | Desourdy | 172/788 |
| 4,074,768 | 2/1978 | Stedman | 172/796 |
| 4,076,080 | 2/1978 | Anderson | 172/247 X |
| 4,084,643 | 4/1978 | Easterling | 172/795 |
| 4,161,987 | 7/1979 | Tolmer | 172/791 |
| 4,213,507 | 7/1980 | Horrer et al. | 172/788 X |
| 4,355,945 | 10/1982 | Pilch | 172/274 X |
| 4,436,477 | 3/1984 | Lenertz et al. | 37/117.5 X |

FOREIGN PATENT DOCUMENTS

| | | | |
|---|---|---|---|
| 2368584 | 5/1978 | France . | |
| 1049628 | 10/1983 | U.S.S.R. | 37/117.5 |

*Primary Examiner*—Richard T. Stouffer

*Attorney, Agent, or Firm*—Merchant, Gould, Smith, Edell, Welter & Schmidt

[57] ABSTRACT

Attachment for wheel-mounted loaders comprising a frame releasably connectible to the loader, extending forwardly from the loader in the normal travelling direction thereof and supporting a grader blade for operations such as grading, road maintenance and the like. To provide a stable and strong unit, the attachment is adapted to be mounted directly on the chassis of the loader and is intended to be an independently operable unit. The attachment is adapted to be easily connected to the loader, the available hydraulic and electric systems being utilized without any additional installations except for control units and switches, thus making the connection of the attachment very comfortable.

10 Claims, 9 Drawing Figures

GRADER ATTACHMENT FOR A LOADER

The present invention relates to an attachment for machines such as wheel-mounted loaders and the like, especially a grader attachment, which has a frame releasably connectible to the machine, extending forwardly from the machine in the normal travelling direction thereof and supporting an implement for operations such as grading, road maintenance and the like.

Conventional motor graders are designed for a rather limited field of use, and furthermore their construction does not allow other applications. As a result, conventional motor graders have a low degree of utilisation and frequently are idle over long periods of time.

An attachment for small wheel-mounted loaders is previously known and comprises a frame which supports all the equipment required for the work to be done. However, this attachment is mounted directly on lifting arms which are part of the machine and intended for various implements. The drawbacks of this attachment are, on one hand, that it is difficult to control and, on the other hand, that the lifting arms and their mountings have originally been dimensioned for quite different loads, i.e. loads of other magnitudes and in other directions, which may cause fatigue, buckling and fracture during use of the attachment.

The present invention aims at eliminating these difficulties, and this is achieved in a manner as ingenious as it is simple in that the attachment and its frame constitute a unit which is directly connectible to the chassis of the machine and is independently operable.

At the same time as the invention eliminates the said difficulties and drawbacks, it presents a number of interesting solutions to the construction details of such an attachment.

The invention will be described in detail below, reference being had to the accompanying drawings showing preferred embodiments.

Figure 1:
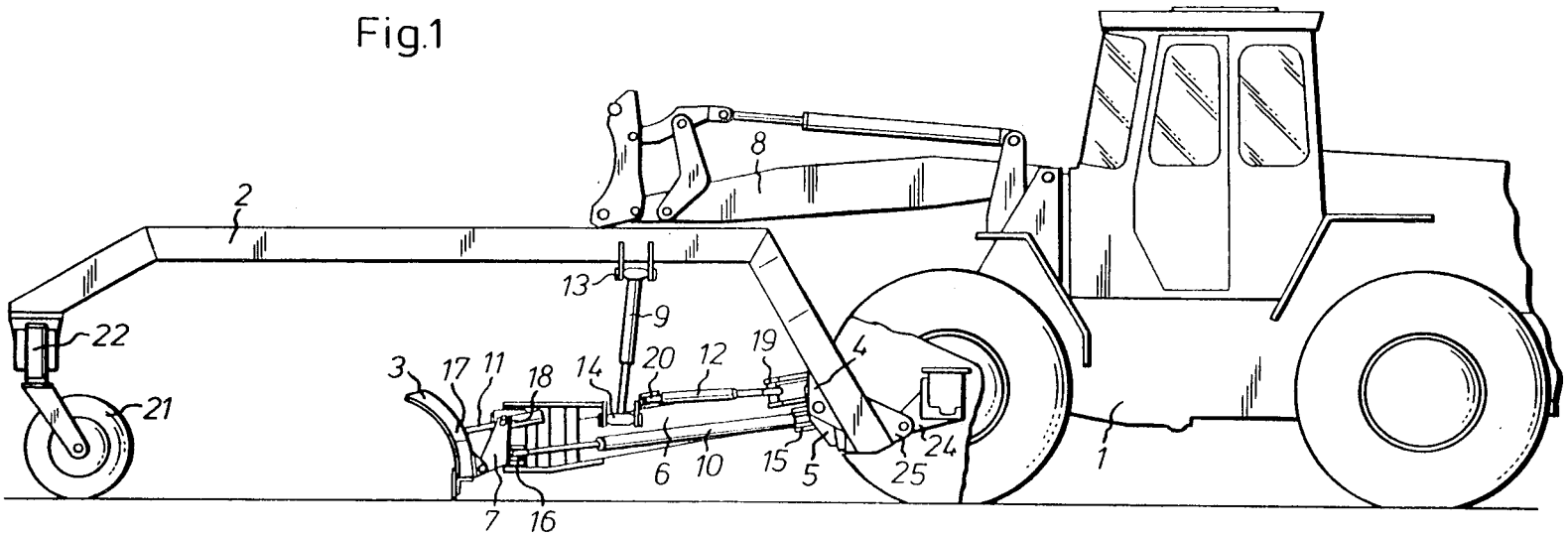
FIG. 1 is a lateral view of a wheel-mounted loader with the attachment mounted thereon.
Figure 3:
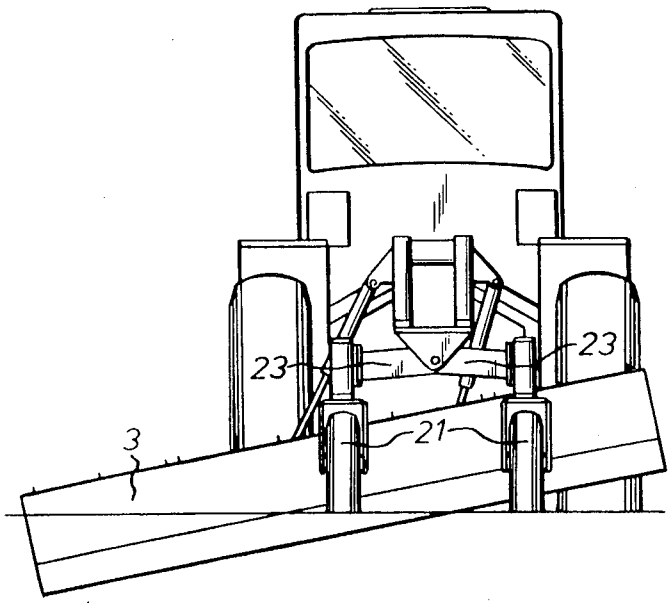
FIG. 3 is a view according to FIG. 2, in which the attachment blade is tilted.
Figure 2:
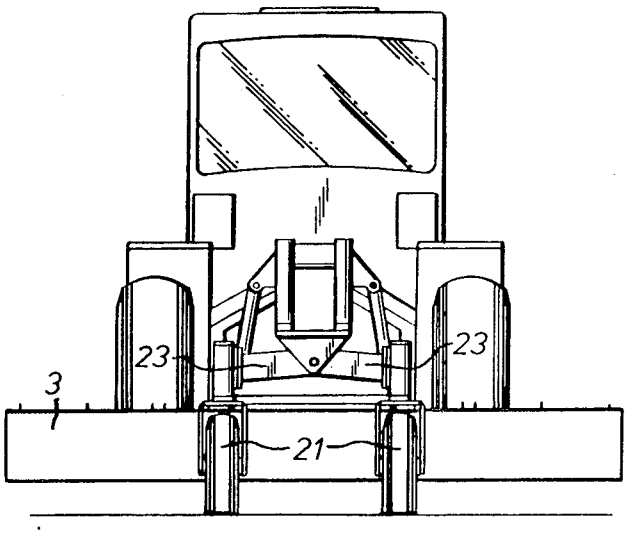
FIG. 2 shows the wheel-mounted loader with the attachment as seen directly from in front.
Figure 4:
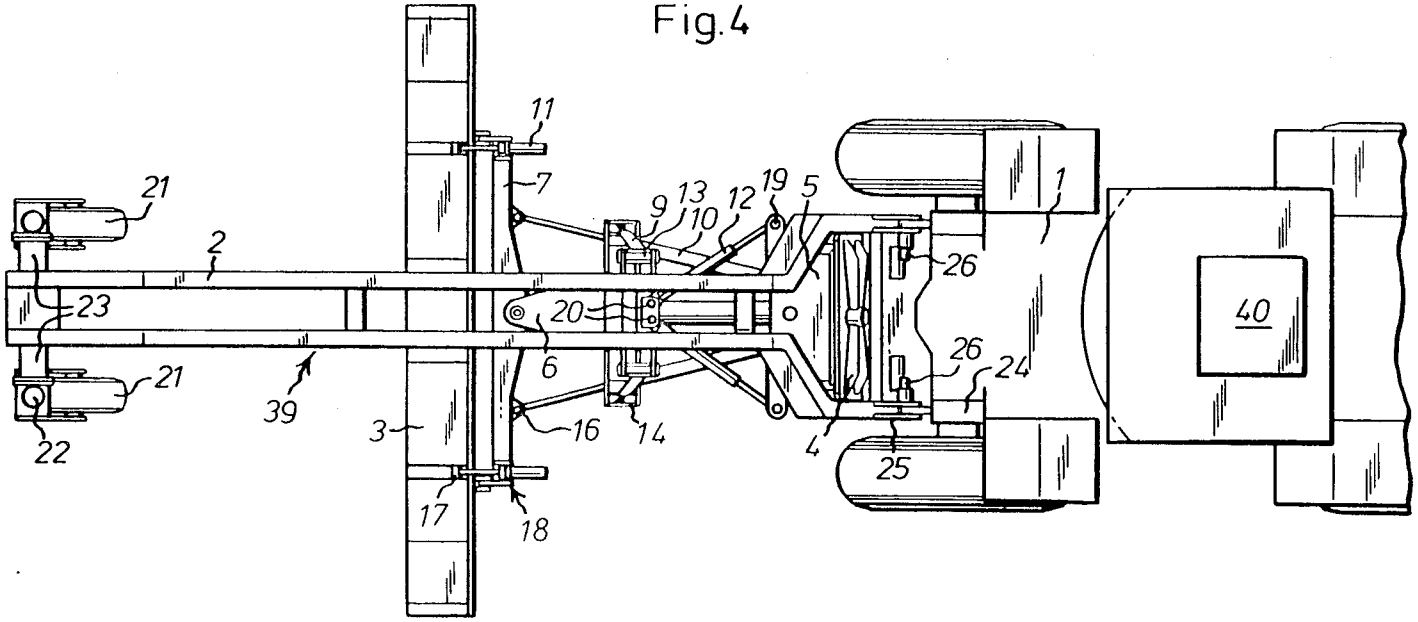
FIG. 4 is a top plan view of the arrangement according to FIGS. 1 and 2.
Figure 5:
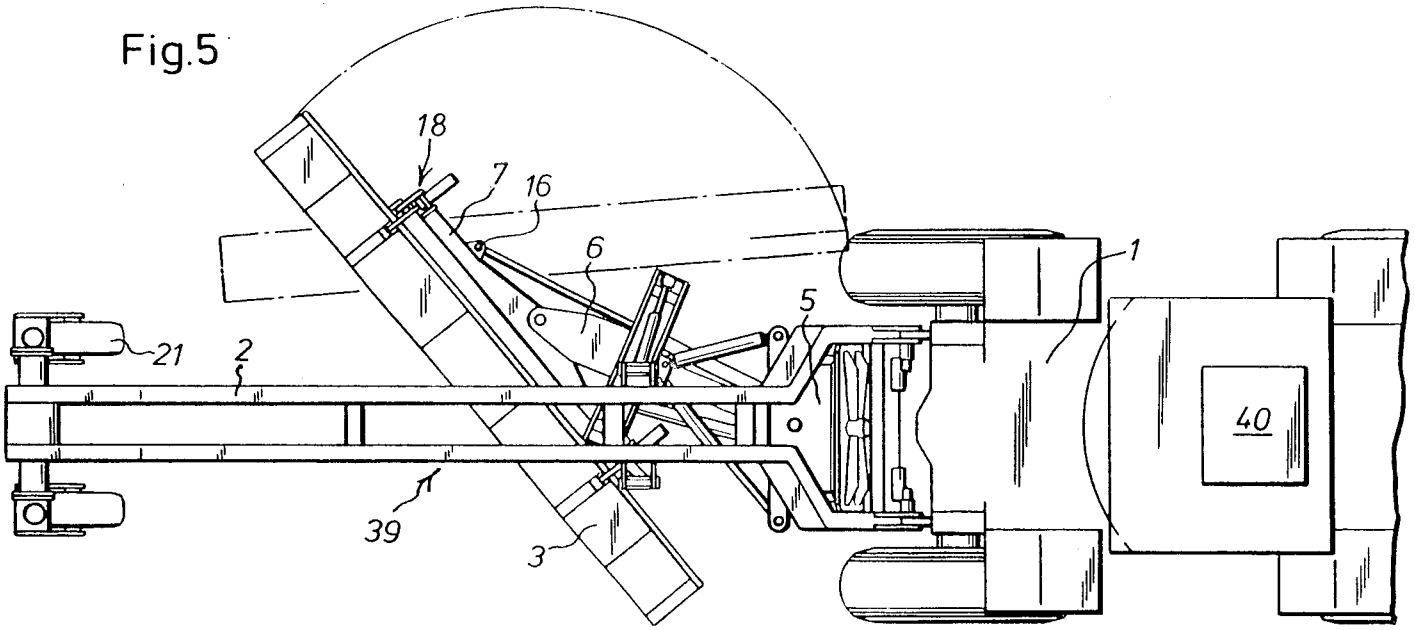
FIG. 5 is a top plan view of the wheel-mounted loader with the attachment, in which the blade has been turned.
Figure 6:
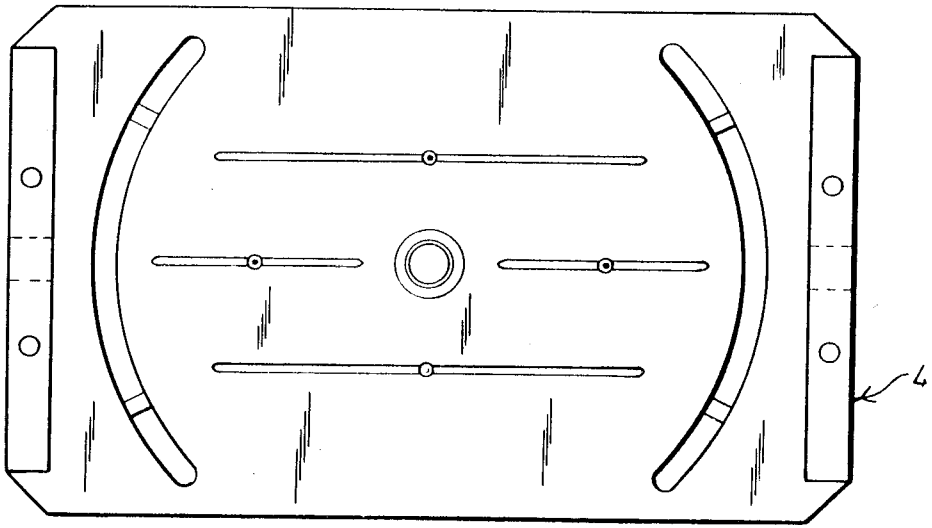
FIG. 6 shows a coordinate plate included in the attachment.
Figure 7:
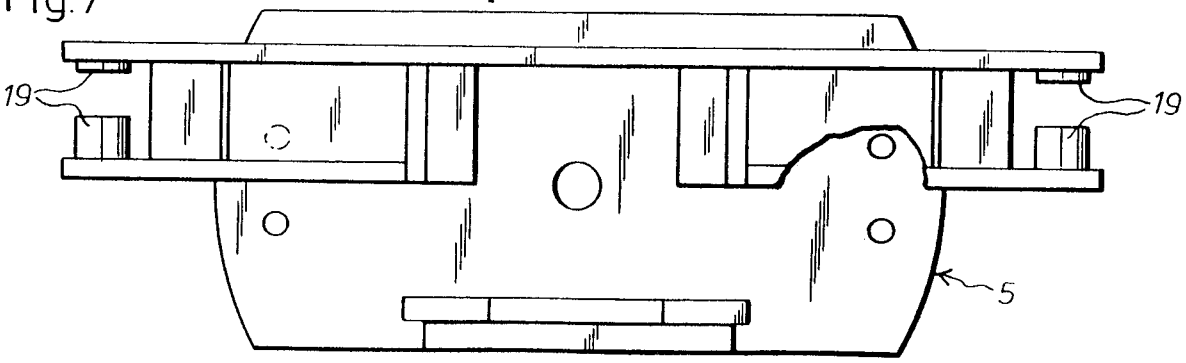
FIG. 7 shows a pivot plate included in the attachment.

A grader attachment according to the present invention, adapted for wheel-mounted loaders and the like, consists of a frame 2 manufactured of rectangular hollow sections and connected to the chassis 1 of the machine, to which frame a grader blade 3 with accessories is, in turn, attached by means of a coordinate plate 4, a pivot plate 5, a pusher boom 6 and a crossbeam 7.

The pivot plate 5 is pivotally connected to the coordinate plate 4 in their common plane and the coordinate plate 4 is pivotal in the transverse direction of said plane for raising and lowering the grader blade 3. All movements of the grader attachment constitute a coordinated movement of a number of hydraulic cylinders relative to one another. The mounting and function of these cylinders is described below.

Two skewing cylinders 9 are mounted on the one hand on the frame 2 of the attachment (at 13) and, on the other hand, at two symmetric connecting points 14 on the pusher boom 6 and serve to raise and lower the blade 3 on the right and the left side, respectively. For slewing the grader blade 3 in relation to the pusher boom 6, two slewing cylinders 10 are arranged between the pivot plate 5 (at 15) and the crossbeam 7 (at 16). The grader blade 3 is tilted by means of two tilt cylinders 11 which are arranged between the blade 3 (at 17) and the crossbeam 7 (at 18). Furthermore, it is possible to move the center of pivotment of the grader blade 3 by slewing the pusher boom 6 to the left or right by means of two displacement cylinders 12 mounted between the pivot plate 5 (at 19) and the pusher boom (at 20). The mechanical connection to the wheel-mounted loader is made hydraulically by two pins which are operated by hydraulic means mounted in the frame 2. The attachment as a whole is supported, on one hand, by a hinged suspension in the chassis 1 of the machine 40 and, on the other hand, by at least one pivot wheel 21 which is rotatable through 360° about its journal 22. The journal or journals 22 are mounted in a bogie beam 23 which in turn is hingedly suspended in the frame 2 of the attachment, thus allowing the pivot wheel/wheels 21 to follow the inclination of the road.

For connecting the attachment to the chassis 1 of the wheel-mounted loader 40, two brackets 24 are mounted on the chassis 1, more precisely on the front drive axle. The attachment is connected, in the manner described above, to the brackets 24 by electrohydraulic means. If required, the electric connection is a multipole contact plug, and the hydraulic connection may consist of two high-pressure hoses with quick couplings connected to the normal hydraulic system of the machine.

For alignment of the attachment relative to the brackets 24 on the machine, the attachment is equipped with hydraulic supporting legs (not shown) for easy adjustment on uneven ground when the grader attachment is coupled to the machine.

Figure 8:
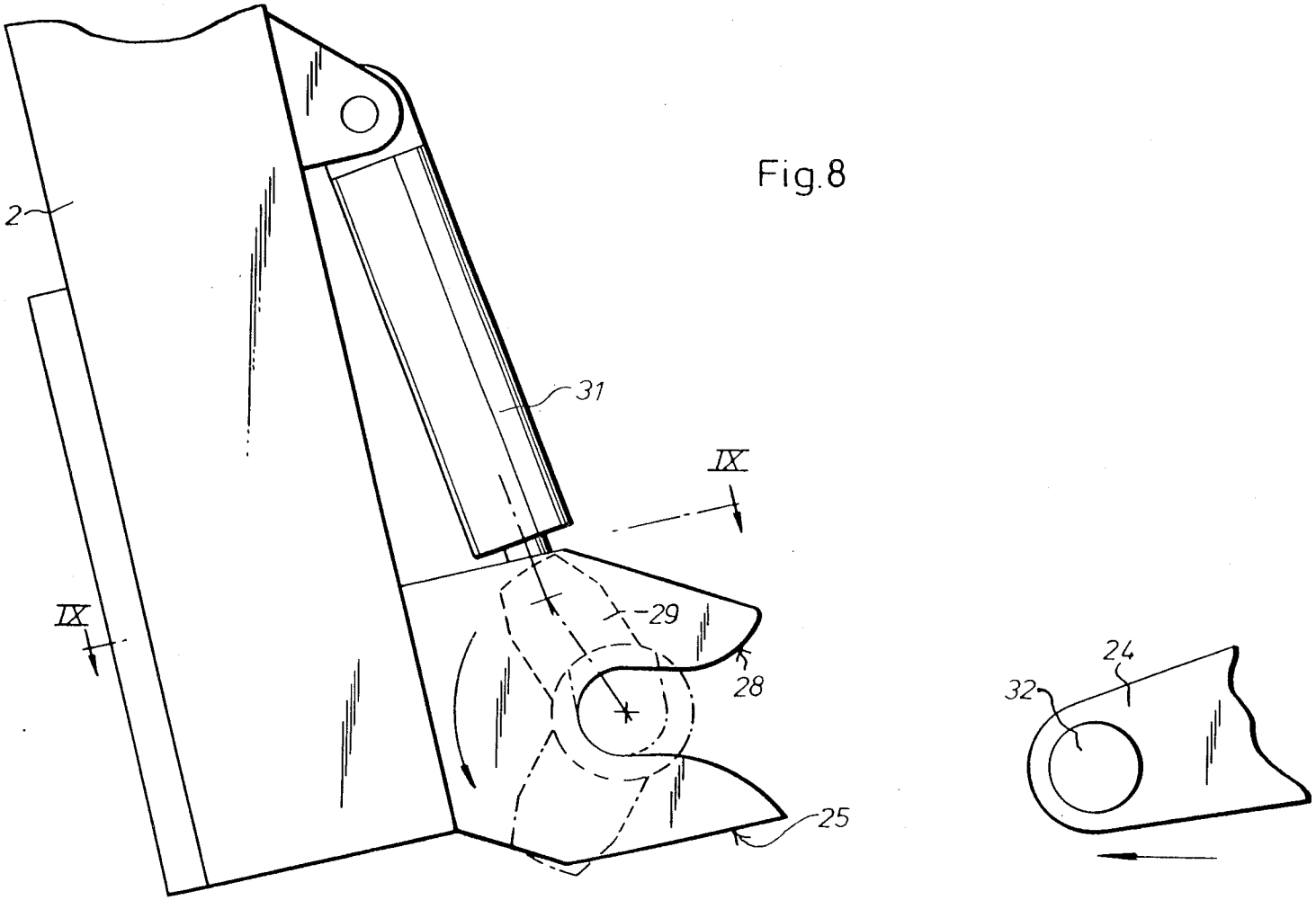
FIG. 8 is a lateral view of an alternative arrangement for connecting the attachment to the chassis of the machine.
Figure 9:
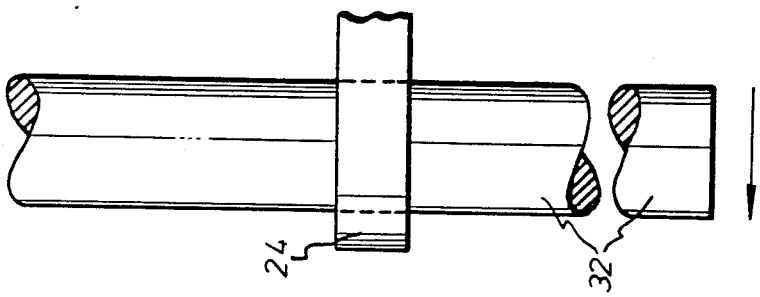
FIG. 9 shows the arrangement along line IX—IX in FIG. 8.
Figure 9:
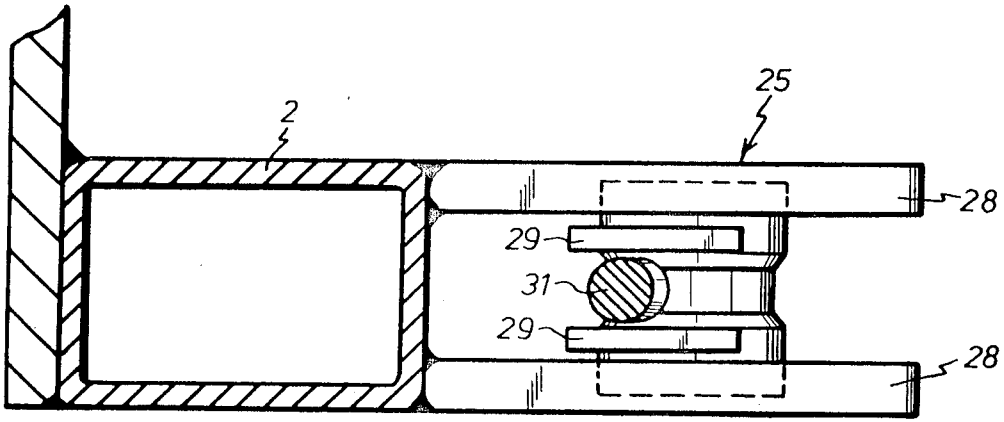

As mentioned before, the attachment is manoeuvered by electrohydraulic means comprising a couple of control units and switches which are conveniently located in the driver's cab and which need not be set up permanently. Instead of the above-mentioned mechanical connection by means of two hydraulically operated pins which are mounted in the frame, a connection according to the embodiment shown in FIGS. 8 and 9 may be used. This connection comprises, as shown, a connecting fork 28 in both the right and the left portion of the frame 2. In the fork 28, a pivotal locking member 29 is mounted which, during the coupling operation, is pivoted to such a position that it coincides substantially with the mouth of the connecting fork 28. For locking, the locking member 29 is pivoted through about one third of a revolution, a fixedly mounted journal 32 in the above-mentioned brackets 24 being embraced by the connecting fork 28 and the locking member 29. The locking member 29 is pivoted by means of a hydraulic cylinder 31 mounted on either side of the frame 2, said hydraulic cylinder actuating the locking member by means of a lever 30 arranged on the locking member 29 between the lower connecting point of the hydraulic cylinder and the point of pivotment of the connecting fork 28.

The upper mounting of the hydraulic cylinder 31 and the connecting fork 28 are connected to frame portions, like in the preceding embodiment. The fixedly mounted journal 32 may be one long axle extending through both brackets 24 or, alternatively, two journals each in a bracket 24. On the right and left outer sides, the journal or journals are elongated, thus making it possible to connect attachments of different coupling dimensions.

What I claim and desire to secure by Letters Patent is:

1. A grader attachment for a loader or the like having a chassis, which comprises:

an elongated frame having front and rear ends;

at least one pivot wheel connected to the front end of said frame;

a coordinate plate connected to the rear end of said frame for pivotal movement about a generally transverse first axis;

a pivot plate connected to said coordinate plate for pivotal movement about a generally longitudinal axis;

a cross beam extending beneath said frame and between said pivot wheel and said pivot plate;

a pusher boom coupled between said cross beam and said pivot plate;

skewing means for selectively adjusting vertical pivotal positioning of said pusher boom relative to said frame;

first skewing means for selectively adjusting horizontal pivotal positioning of said pusher boom relative to said frame;

a grader blade connected to said cross beam for pivotal movement about a generally transverse second axis;

tilt means for selectively adjusting vertical pivotal positioning of said blade relative to said cross beam;

second slewing means for selectively adjusting horizontal pivotal positioning of said cross beam relative to said pusher boom; and means for releasably attaching the rear end of said frame at two transversely spaced-apart points to the chassis of said loader.

2. The grader attachment of claim 1, wherein said skewing means comprises a pair of transversely spaced apart cylinders coupled between said frame and said pusher boom.

3. The grader attachment of claim 1, wherein said first slewing means comprises a pair of transversely spaced apart cylinders coupled between said pivot plate and said pusher boom.

4. The grader attachment of claim 1, wherein said tilt means comprises a pair of transversely spaced apart cylinders coupled between said blade and said cross beam.

5. The grader attachment of claim 1, wherein said second slewing means comprises a pair of transversely spaced apart cylinders coupled between said cross beam and said pivot plate.

6. The grader attachment of claim 1, wherein said releasably attaching means comprises:

a pair of spaced apart brackets adapted to be secured to the chassis of said loader;

a journal secured between said brackets;

a pair of spaced apart connecting forks secured to the rear end of said frame, said forks being adapted to receive said journal therein;

pivotal locking members associated with each of said connected forks, said locking members being movable between released and locked positions relative to said journal when received in said connecting forks; and means for selectively actuating said locking members between the open and locked positions.

7. The grader attachment of claim 1, further including:

a bogie beam pivotally connected to the front end of said frame;

said at least one pivot wheel comprising two pivot wheels connected to said bogie beam in spaced apart relationship.

8. A grader attachment for a loader or the like having a chassis, which comprises:

an elongated frame having front and rear ends;

a bogie beam connected to the front end of said frame for pivotal movement about a generally longitudinal axis;

a pair of transversely spaced apart pivot wheels connected to said bogie beam;

a coordinate plate connected to the rear end of said frame for pivotal movement about a generally transverse first axis;

a pivot plate connected to said coordinate plate for pivotal movement about a generally longitudinal axis;

a cross beam extending beneath said frame and between said pivot wheels and said pivot plate;

a pusher boom coupled between said cross beam and said pivot plate;

skewing means for selectively adjusting vertical pivotal positioning of said pusher boom relative to said frame;

first slewing means for selectively adjusting horizontal pivotal positioning of said pusher boom relative to said frame;

a grader blade connected to said cross beam for pivotal movement about a generally transverse second axis;

tilt means for selectively adjusting vertical pivotal positioning of said blade relative to said cross beam;

second slewing means for selectively adjusting horizontal pivotal positioning of said cross beam relative to said pusher boom; and means for releasably attaching the rear end of said frame at two transversely spaced-apart points to the chassis of said loader.

9. A grader attachment for a loader or the like having a chassis, which comprises:

an elongated frame having front and rear ends;

at least one pivot wheel connected to the front end of said frame;

a coordinate plate connected to the rear end of said frame for pivotal movement about a generally transverse first axis;

a pivot plate connected to said coordinate plate for pivotal movement about a generally longitudinal axis;

a cross beam extending beneath said frame and between said pivot wheel and said pivot plate;

a pusher boom coupled between said cross beam and said pivot plate;

skewing means for selectively adjusting vertical pivotal positioning of said pusher boom relative to said frame;

first slewing means for selectively adjusting horizontal pivotal positioning of said pusher boom relative to said frame;

a grader blade connected to said cross beam for pivotal movement about a generally transverse second axis;

tilt means for selectively adjusting vertical pivotal positioning of said blade relative to said cross beam;

second slewing means for selectively adjusting horizontal pivotal positioning of said cross beam relative to said pusher boom;

a pair of spaced apart brackets adapted to be secured to the chassis of said loader;

a journal secured between said brackets;

a pair of spaced apart connecting forks secured to the rear end of said frame, said forks being adapted to receive said journal therein;

pivotal locking members associated with each of said connecting forks, said locking members being movable between open and locked positions relative to said journal when received in said connecting forks; and means for selectively actuating said locking members between the open and locked positions.

10. The grader attachment of claim 9, further including:

a bogie beam pivotally connected to the front end of said frame;

said at least one pivot wheel comprising two pivot wheels connected to said bogie beam in spaced apart relationship.

* * * * *